US010633218B2

(12) United States Patent
Wang

(10) Patent No.: US 10,633,218 B2
(45) Date of Patent: Apr. 28, 2020

(54) REEL DEVICE

(71) Applicant: Yu-Chien Wang, Taichung (TW)

(72) Inventor: Yu-Chien Wang, Taichung (TW)

( * ) Notice: Subject to any disclaimer, the term of this patent is extended or adjusted under 35 U.S.C. 154(b) by 0 days.

(21) Appl. No.: 16/130,449

(22) Filed: Sep. 13, 2018

(65) Prior Publication Data

US 2020/0087104 A1 Mar. 19, 2020

(51) Int. Cl.
*B65H 75/44* (2006.01)

(52) U.S. Cl.
CPC ..... *B65H 75/4415* (2013.01); *B65H 75/4465* (2013.01); *B65H 75/4471* (2013.01); *B65H 75/4492* (2013.01)

(58) Field of Classification Search
CPC ..... B65H 75/4415; B65H 75/4465; B65H 75/4471; B65H 75/4492; B65H 75/44
See application file for complete search history.

(56) References Cited

U.S. PATENT DOCUMENTS

2015/0312667 A1* 10/2015 Lei ..... H04R 1/1033 242/379
2018/0160775 A1* 6/2018 Pollack ..... F16G 11/12
2018/0168259 A1* 6/2018 Kim ..... A41F 1/00

* cited by examiner

*Primary Examiner* — Sang K Kim
(74) *Attorney, Agent, or Firm* — Muncy, Geissler, Olds & Lowe, P.C.

(57) ABSTRACT

A reel device is provided, including a shell body; a rotating shaft, movably and rotatably disposed in the shell body along an axial direction, the rotating shaft including a head section, an exterior circumferential face of the head section circumferentially having a plurality of engaging teeth circumferentially disposed thereon and extending radially; a ratchet assembly, including a first ratchet portion and a second ratchet portion meshed with the first ratchet portion, the first ratchet portion being fixed on the shell body, the second ratchet portion being rotatable relative to the first ratchet portion unidirectionally, the second ratchet portion comovably connected with the rotating shaft; a reel unit, rotatably disposed on the shell body for being connected to at least one rope, the reel unit having a meshed hole extending in the axial direction, the plurality of engaging teeth being radially detachably engaged with the meshed hole.

10 Claims, 8 Drawing Sheets

REEL DEVICE

BACKGROUND OF THE INVENTION

Field of the Invention

The present invention relates to a reel device which is rotatable and foldable.

Description of the Prior Art

Generally, to meet a user's requirements, a common wearable equipment such as shoes and protective equipment has an adjustable structure for being adjusted to an appropriate tightness and height for the user. For example, a neck brace provides a height adjusting feature to adjust an upper edge height of the neck brace to support a front edge of the chin of the user so that the user can look forward at eye-level.

However, this type of conventional reel device includes a sticky buckle member which is disposed through a wearable device, the sticky buckle member can positionably buckle the rope, and the user can pull the sticky buckle member to drive the rope to move up and down and positionably buckle the rope. The sticky buckle member may be, for example, a Velcro, and easily loosened; therefore, the rope may be easily loosened, and the sticky buckle member is unable to buckle the rope firmly so that the rope will slide or fall off relative to the sticky buckle member and that the protective equipment cannot wrap around a human body part tightly and closely.

The present invention has arisen to mitigate and/or obviate the afore-described disadvantages.

SUMMARY OF THE INVENTION

The major object of the present invention is to provide a reel device, which can effectively release or wrap a rope with a simple structure and prevent the rope from getting loose.

To achieve the above and other objects, a reel device is provided, including a shell body; a rotating shaft, movably along an axial direction and rotatably disposed in the shell body, the rotating shaft including a head section, an exterior circumferential face of the head section circumferentially having a plurality of engaging teeth circumferentially disposed thereon and extending radially; a ratchet assembly, including a first ratchet portion and a second ratchet portion which is meshed with the first ratchet portion, the first ratchet portion being fixed on the shell body, the second ratchet portion being rotatable relative to the first ratchet portion unidirectionally, the second ratchet portion comovably connected with the rotating shaft; a reel unit, rotatably disposed on the shell body for being connected to at least one rope, the reel unit having a meshed hole which extends in the axial direction, the plurality of engaging teeth being radially detachably engaged with the meshed hole.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
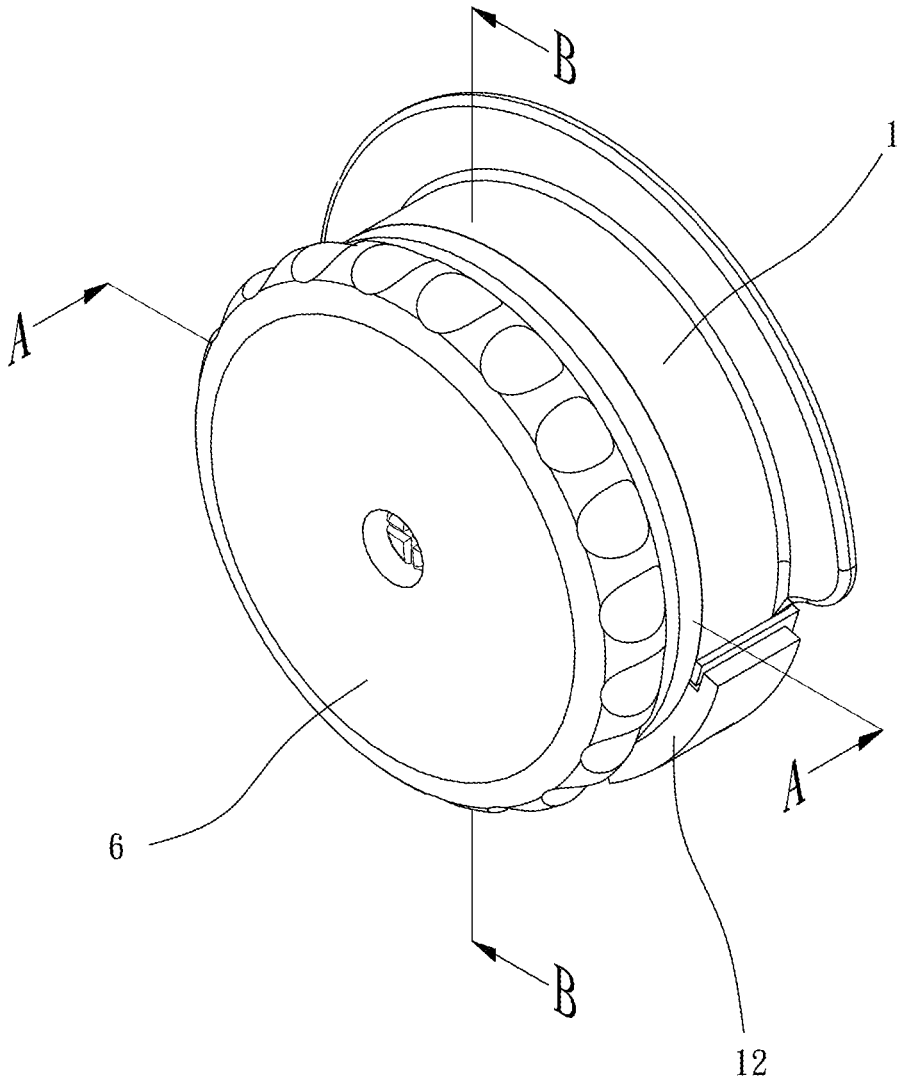
FIG. 1 is a stereogram of a preferred embodiment of the present invention.
Figure 2:
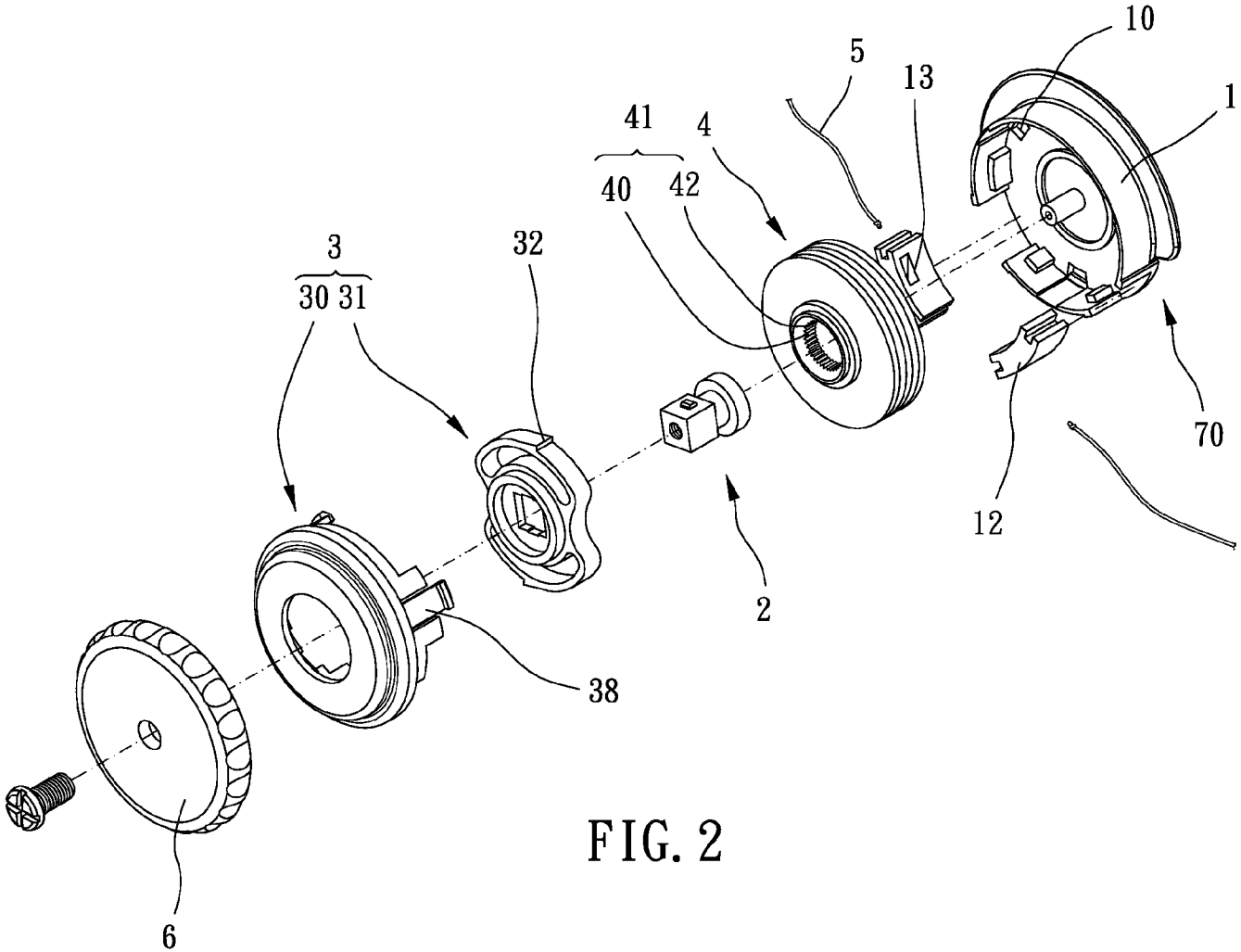
FIG. 2 is a breakdown view of the preferred embodiment of the present invention.
Figure 3:
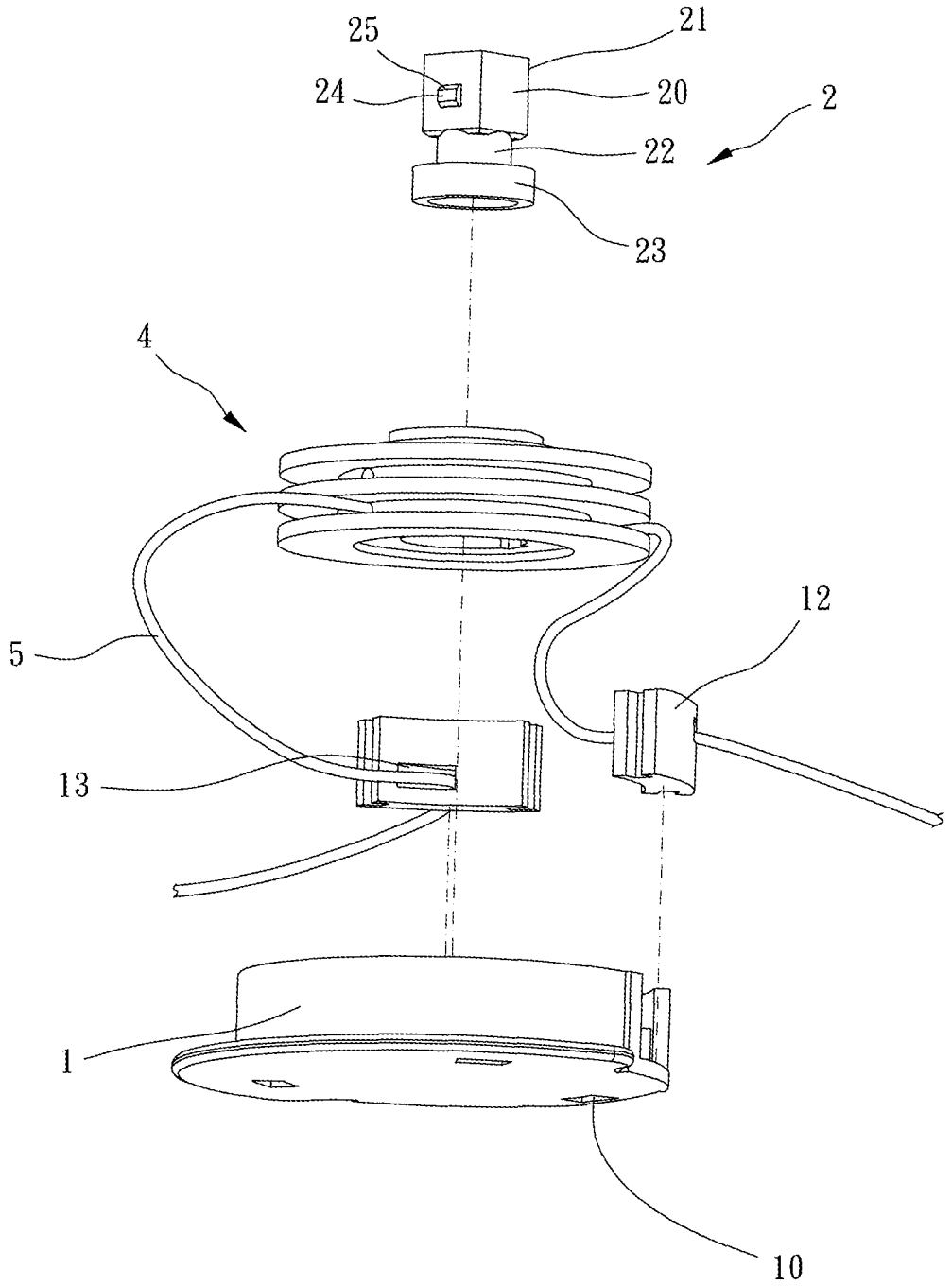
FIG. 3 is a partially breakdown view of the preferred embodiment of the present invention.
Figure 4:
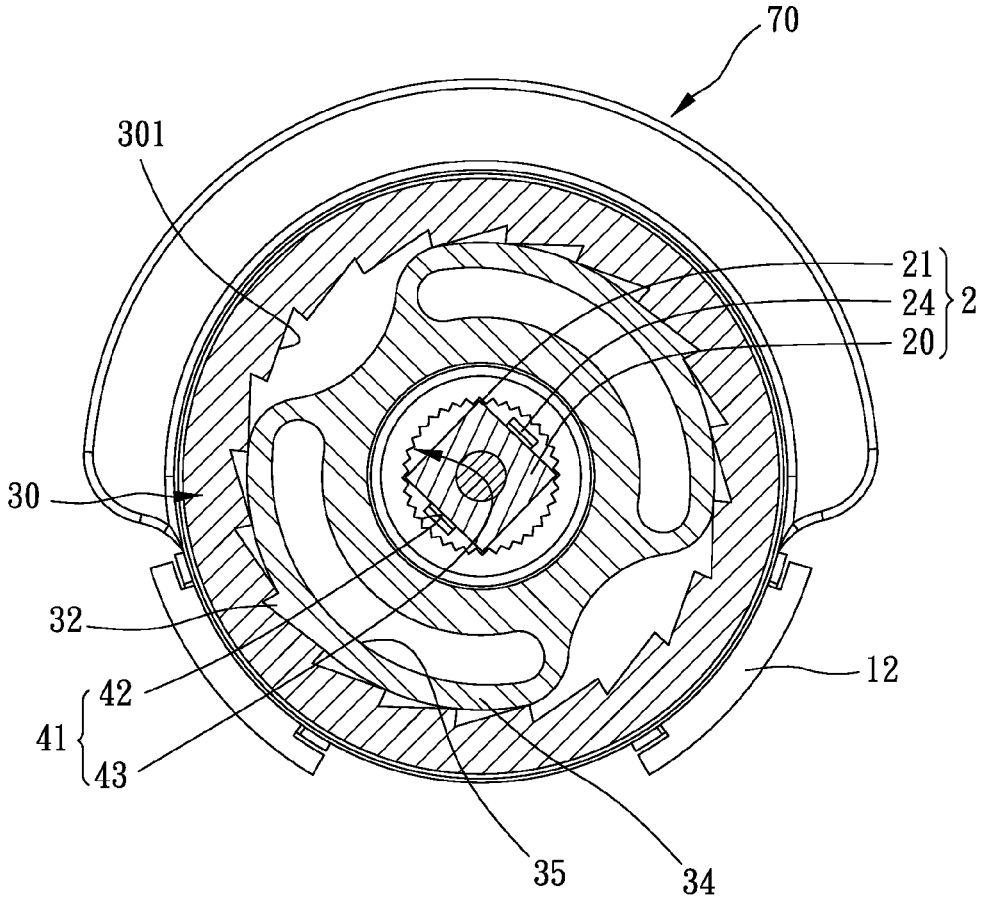
FIG. 4 is a cross-sectional view, taken along line A-A of FIG. 1.
Figure 5:
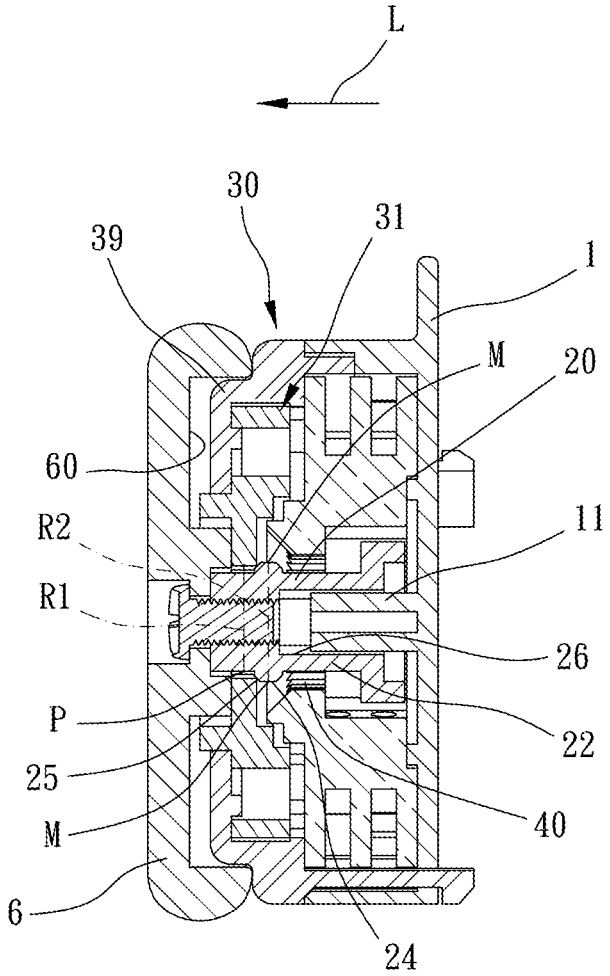
FIG. 5 is a cross-sectional view, taken along line B-B of FIG. 1.
Figure 6:
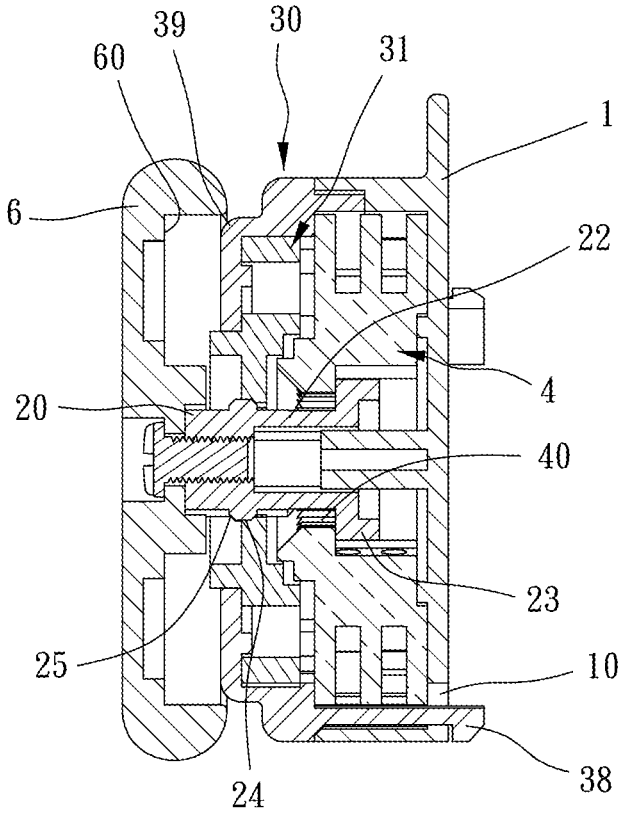
FIG. 6 is a drawing showing the preferred embodiment of the present invention in use.
Figure 7:
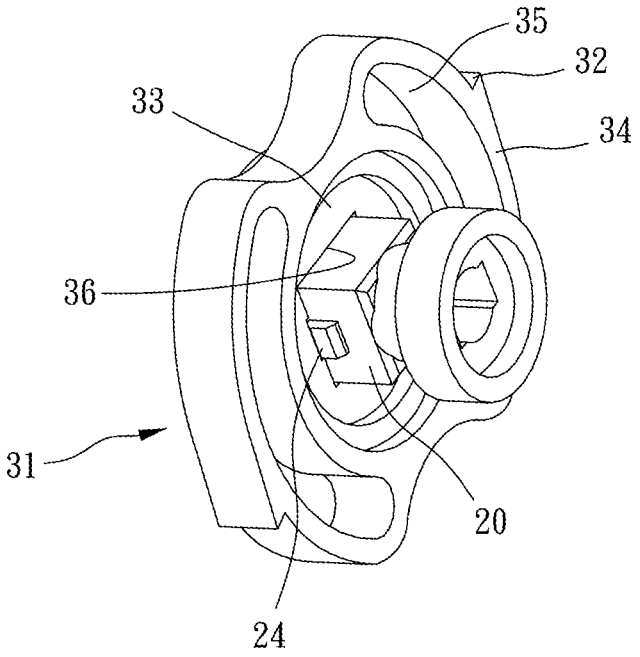
FIG. 7 is a stereogram showing a rotating shaft and a second ratchet portion of the preferred embodiment of the present invention.
Figure 8:
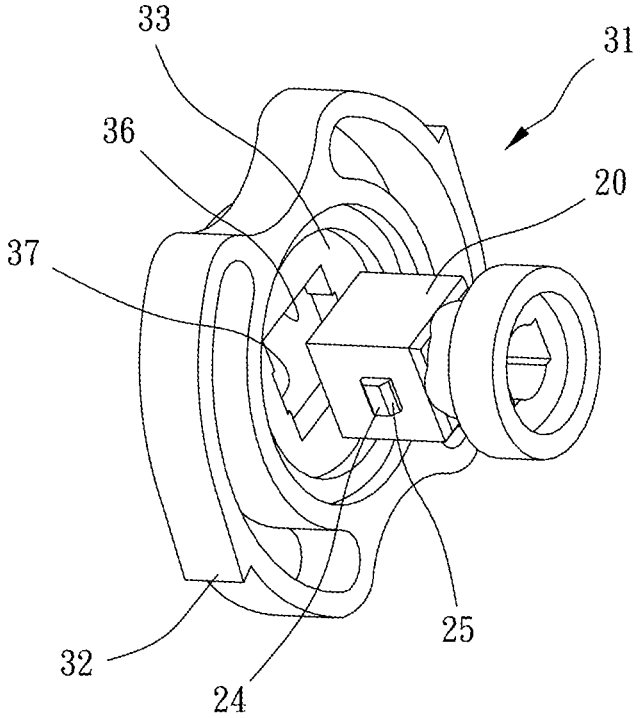
FIG. 8 is a perspective breakdown view of the rotating shaft and the second ratchet portion of the preferred embodiment of the present invention.
Figure 9:
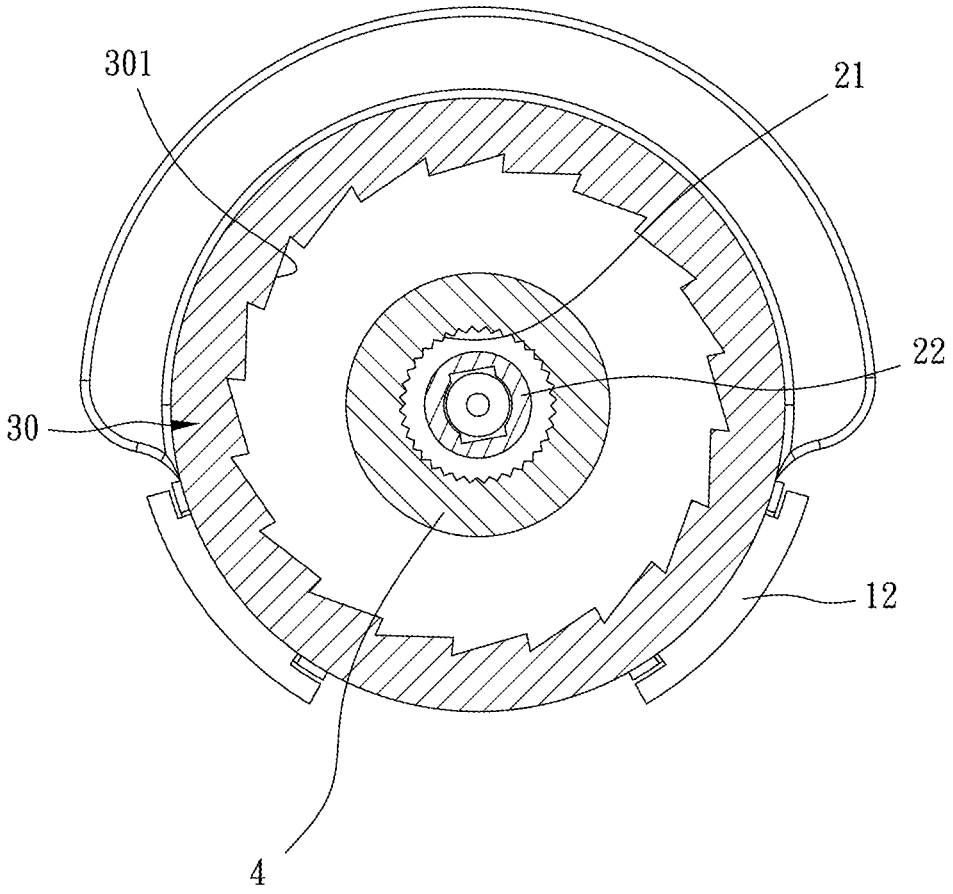
FIG. 9 is a cross-sectional view of the preferred embodiment of the present invention in a rope releasing state.

Please refer to FIGS. 1 to 9 for a preferred embodiment of the present invention. A reel device includes a shell body 1, a rotating shaft 2, a ratchet assembly 3 and a reel unit 4.

The shell body 1 includes a base seat 70. The rotating shaft 2 is movably along an axial direction L and rotatably disposed in the shell body 1, the rotating shaft 2 includes a head section 20, and an exterior circumferential face of the head section 20 circumferentially has a plurality of engaging teeth 21 circumferentially disposed thereon and extending radially, and the rotating shaft 2 is rotatably disposed on and axially movable relative to the base seat 70; a ratchet assembly 3 includes a first ratchet portion 30 and a second ratchet portion 31 which is meshed with the first ratchet portion 30, the first ratchet portion 30 is fixed on the shell body 1, the second ratchet portion 31 is rotatable relative to the first ratchet portion 30 unidirectionally, and the second ratchet portion 31 is comovably connected with the rotating shaft 2, and the second ratchet portion 31 being rotatable relative to the base seat 70; a reel unit 4 is rotatably disposed on the shell body 1 for being connected to at least one rope 5, the reel unit 4 has a mesh portion 41, the mesh portion 41 includes the meshed hole 40 which extends in the axial direction L and an inner surface 42 enclosing the meshed hole 40, the inner surface 42 of the meshed hole 40 has a plurality of tooth portions circumferentially, and the plurality of engaging teeth 21 are radially detachably engaged with the meshed hole 40; and the inner surface 42 has a plurality recesses 43 circumferentially disposed thereon, each of the plurality recesses 43 faces the rotating shaft 2, and each of the plurality of the engaging teeth 21 is detachably engaged within one of the plurality recesses 43; thereby, the reel device can effectively release or wrap a rope with a simple structure and prevent the rope from getting loose. In this embodiment, the rotating shaft 2 is movable relative to the reel unit along the axial direction L so as to be loosened from or engaged with the meshed hole 40 to wrap or release the rope 5. In other embodiments, the rotating shaft drives the second ratchet portion to be loosened and meshed with the first ratchet portion, and the rotating shaft may be detachably connected to the second ratchet portion to choose either to rotate unidirectionally or freely.

The rotating shaft 2 further includes a neck section 22 and a diameter expansion section 23, the neck section 22 is disposed between the head section 20 and the diameter expansion section 23, the neck section 22 is disposed into the meshed hole 40, and the diameter expansion section 23 is abuttable against the reel unit 4 on the axial direction L so that when the head section 20 is detached from the meshed hole 40, the reel unit 40 can rotate freely relative to the neck section 22. In this embodiment, the head section 20 is a polygonal column, as viewed in the axial direction, the polygonal column is a square column, and in other embodiments, the head section may be a square column or polygonal columns like a diamond column, a two-cornered column or a triangular column for the plurality of engaging teeth to be meshed with the meshed hole smoothly. Specifically, each of the plurality of engaging teeth 21 is a corner of the polygonal column.

The second ratchet portion 31 has a plurality of ratchets 32 which are radially elastically movable, and each of the plurality of ratchets 32 is meshed with the first ratchet portion 30. Specifically, the first ratchet portion 30 is an interior ring gear, the interior ring gear has the plurality of tooth portions 301 which extend toward a single direction, the second ratchet portion 31 further includes an axle portion 33 and a plurality of arm portions 34, the plurality of arm portions 34 are circumferentially connected to an exterior circumference of the axle portion 33, each of the plurality of arm portions 34 has one of the plurality of ratchets 32, and each of the plurality of arm portions 34 radially abuts against the interior ring gear, each of the plurality of arm portions 34 abuts against the interior ring gear with a radial elastic force, when the second ratchet portion 31 rotates relative to the first ratchet portion 30, each of the plurality of ratchets 32 can be smoothly detached from or meshed with the first ratchet portion 30, and the first ratchet portion 30 and the second ratchet portion 31 are not easily detachable from each other. Preferably, each of the plurality of arm portions 34 is a curved protrusive arm which protrudes radially outward; specifically, each of the plurality of ratchets 32 is an apical tooth which extends circumferentially so that the second ratchet portion 31 can rotate relative to the first ratchet portion 30 unidirectionally. In addition, two opposite ends of each of the plurality of arm portions 34 are respectively connected to the axle portion 33, and each of the plurality of arm portions 34 and the axle portion 33 define a through hole 35 (which is circumferentially closed) therebetween so that each of the plurality of arm portions 34 can be pressed to deform toward the through hole 35 and elastically restore. In this embodiment, the second ratchet portion 31 may be a butterfly disc so that the two arm portions 34 are disposed on two opposite sides to provide radial force toward two opposite directions to stabilize rotation and limit position.

The second ratchet portion 31 has an axial hole 36, the axial hole 36 is complementary to the head section 20 in shape so that the head section 20 can drive the second ratchet portion 31, the head section 20 is movably disposed into the axial hole 36, one of an exterior side of the head section 20 and an interior side of the axial hole 36 has two protrusions which radially protrude on two opposite sides thereof, the other of the exterior side of the head section 20 and the interior side of the axial hole 36 has two grooves which are recessed on two opposite sides thereof; in this embodiment, the exterior side of the head section 20 has the two protrusions 24, the interior side of the axial hole 36 has the two grooves 37, each of the two protrusions 24 is detachably engaged within one of the two grooves 37, each of the two protrusions 24 defines an outermost end point M on the radial direction, each of the two grooves 37 defines a lowest end portion P on the radial direction, and a distance R2 between the two outermost end points M of the two protrusions 24 is greater than a distance R1 between the two lowest end points P of the two grooves 37 to restrict a movement range of the rotating shaft; specifically, when the rotating shaft 2 is pulled up by a force, the two protrusions 24 can be respectively engaged with one of the two grooves 37. Preferably, each of the two protrusions 24 has at least one skew guide face 25, in this embodiment, the at least one skew guide face 25 is plural, and each of the plurality of skew guide faces 25 abuts against a hole flange of the axial hole 36 to be smoothly engaged within each of the two grooves 37.

The interior ring gear is detachably disposed in the shell body 1; specifically, the shell body 1 has a plurality of buckle holes 10, and the interior ring gear has a plurality of buckle legs 38 which are detachably engaged with one of the plurality of buckle holes 10 to be easily assembled or disassembled; in other embodiments, the shell body and the interior ring gear are screwed with each other. One of the shell body 1 and the rotating shaft 2 has a slot which extends toward the axial direction, and the other of the shell body 1 and the rotating shaft 2 has a shaft column which is disposed through the slot; in other embodiments, the shell body 1 has the shaft column 11, and the rotating shaft 2 has the slot 26 so that the rotating shaft 2 can move stably.

The reel device further includes a screw cap 6, the screw cap 6 is connected to the rotating shaft 2, and the screw cap 6 can drives the rotating shaft 2 to move along the axial direction L and rotate; preferably, one of the screw cap 6 and the first ratchet portion 30 has a positioning groove, and the other of the screw cap 6 and the first ratchet portion 30 has an annular stepped protrusion which is movably arranged in the positioning groove. In this embodiment, the screw cap 6 has the positioning groove 60, and the first ratchet portion 30 has the stepped protrusion 39. The screw cap 6 is rotatable and axially movable relative to the base seat 70 to simultaneously move the rotating shaft 2, and the ratchet assembly 3 and the reel unit 4 are disposed between the screw cap 6 and the base seat 70.

The shell body 1 further includes at least one guide unit 12 which is detachable, the at least one guide unit 12 has a guide hole 13 which extends circumferentially for at least one rope 5 to be disposed therethrough, in this embodiment, the at least one guide unit 12 is plural, and each of the plurality of guide units 12 is a curved board for guiding each of the at least one rope 5 to dispose therethrough and smoothly wrap on the reel unit 34.

In actual practice, when on a first position, each of the plurality of engaging teeth 21 of the head section 20 is meshed with the meshed hole 40, the rotating shaft 2 drives the reel unit 4 to rotate relative to the shell body 1, and the second ratchet portion 31 is meshed with the first ratchet portion 30 to rotate unidirectionally to wrap the rope. On the contrary, when on a second position, in this embodiment, the rotating shaft 2 is pulled upward relative to the shell body 1 to make each of the engaging teeth 21 to be detached from the meshed hole 40 so that the reel unit 4 can rotate freely to release the rope.

While we have shown and described various embodiments in accordance with the present invention, it should be clear to those skilled in the art that further embodiments may be made without departing from the scope of the present invention.

What is claimed is:

1. A reel device, including:

a shell body, including a base seat;

a rotating shaft, movably along an axial direction and rotatably disposed in the shell body, the rotating shaft including a head section, an exterior circumferential face of the head section having a plurality of engaging teeth circumferentially disposed thereon and extending radially;

a ratchet assembly, including a first ratchet portion and a second ratchet portion which is meshed with the first ratchet portion, the first ratchet portion being fixed on the shell body, the second ratchet portion being unidirectionally rotatable relative to the first ratchet portion, the second ratchet portion connected with the rotating shaft, and the second ratchet portion being rotatable relative to the base seat;

a reel unit, rotatably disposed on the shell body for being connected to at least one rope, the reel unit having a meshed hole which extends in the axial direction, the plurality of engaging teeth being detachably engaged with the meshed hole;

wherein the rotating shaft is rotatably disposed on and axially movable relative to the base seat;

wherein the reel device further includes a screw cap, the screw cap is connected with the rotating shaft, and the screw cap is rotatable and axially movable relative to the base seat to simultaneously move the rotating shaft.

2. The reel device of claim 1, wherein the rotating shaft further includes a neck section and a diameter expansion section, the neck section is disposed between the head section and the diameter expansion section, the neck section is disposed into the meshed hole, and the diameter expansion section is abuttable against the reel unit on the axial direction.

3. The reel device of claim 1, wherein the head section is a polygonal column; wherein the ratchet assembly and the reel unit are disposed between the screw cap and the base seat; and wherein the reel unit has a mesh portion, the mesh portion includes the meshed hole and an inner surface enclosing the meshed hole, the inner surface has a plurality recesses circumferentially disposed thereon, each of the plurality recesses faces the rotating shaft, and each of the plurality of the engaging teeth is detachably engaged within one of the plurality recesses.

4. The reel device of claim 1, wherein the second ratchet portion has a plurality of ratchets which are radially elastically movable, and each of the plurality of ratchets is meshed with the first ratchet portion.

5. The reel device of claim 4, wherein the first ratchet portion is an interior ring gear, the second ratchet portion further includes an axle portion and a plurality of arm portions, the plurality of arm portions are circumferentially connected to an exterior circumference of the axle portion, each of the plurality of arm portions has one of the plurality of ratchets, and each of the plurality of arm portions radially abuts against the interior ring gear.

6. The reel device of claim 5, wherein each of the plurality of atm portions is a curved protrusive arm which protrudes radially outward.

7. The reel device of claim 6, wherein each of the plurality of ratchets has an apical tooth which extends circumferentially; the rotating shaft further includes a neck section and a diameter expansion section, the neck section is disposed between the head section and the diameter expansion section, the neck section is disposed into the meshed hole, and the diameter expansion section is abuttable against the reel unit on the axial direction; the head section is a polygonal column; two opposite ends of each of the plurality of arm portions are respectively connected to the axle portion, and each of the plurality of arm portions and the axle portion define a through hole therebetween; the second ratchet portion has an axial hole, the axial hole is complementary to the head section in shape, the head section is movably disposed into the axial hole, one of an exterior side of the head section and an interior side of the axial hole has two protrusions which radially protrude on two opposite sides thereof, the other of the exterior side of the head section and the interior side of the axial hole has two grooves which are recessed on two opposite sides thereof, each of the two protrusions is detachably engaged within one of the two grooves, each of the two protrusions defines an outermost end point on the radial direction, each of the two grooves defines a lowest end portion on the radial direction, and a distance between the two outermost end points of the two protrusions is greater than a distance between the two lowest end points of the two grooves; each of the two protrusions has a skew guide face; the interior ring gear is detachably disposed in the shell body; the shell body has a plurality of buckle holes, and the interior ring gear has a plurality of buckle legs which are detachably engaged with one of the plurality of buckle holes; one of the shell body and the rotating shaft has a slot which extends toward the axial direction, and the other of the shell body and the rotating shaft has a shaft column which is disposed through the slot; one of the screw cap and the first ratchet portion has a positioning groove, and the other of the screw cap and the first ratchet portion has an annular stepped protrusion which is movably arranged in the positioning groove; the shell body further includes at least one guide unit which is detachable, the at least one guide unit has a guide hole which extends circumferentially for at least one rope to be disposed therethrough, and each of the at least one guide unit is a curved board.

8. The reel device of claim 5, wherein two opposite ends of each of the plurality of arm portions are respectively connected to the axle portion, and each of the plurality of arm portions and the axle portion define a through hole therebetween.

9. The reel device of claim 1, wherein the second ratchet portion has an axial hole, the axial hole is complementary to the head section in shape, the head section is movably disposed into the axial hole, one of an exterior side of the head section and an interior side of the axial hole has two protrusions which radially protrude on two opposite sides thereof, the other of the exterior side of the head section and the interior side of the axial hole has two grooves which are recessed on two opposite sides thereof, each of the two protrusions is detachably engaged within one of the two grooves, each of the two protrusions defines an outermost end point on the radial direction, each of the two grooves defines a lowest end portion on the radial direction, and a distance between the two outermost end points of the two protrusions is greater than a distance between the two lowest end points of the two grooves.

10. The reel device of claim 9, wherein each of the two protrusions has at least one skew guide face.

* * * * *